US006412374B1

(12) United States Patent
Hsieh

(10) Patent No.: US 6,412,374 B1
(45) Date of Patent: Jul. 2, 2002

(54) MULTISECTION WRENCH

(76) Inventor: Chih-Ching Hsieh, No. 367-1, Pei Yang Road, Feng Yuan, Taichung (TW)

( * ) Notice: Subject to any disclaimer, the term of this patent is extended or adjusted under 35 U.S.C. 154(b) by 0 days.

(21) Appl. No.: 09/925,328

(22) Filed: Aug. 10, 2001

(51) Int. Cl.[7] ..... B25B 23/16
(52) U.S. Cl. ..... 81/177.7; 81/177.6
(58) Field of Search ..... 81/177.8, 177.9, 81/177.6, 177.7

(56) References Cited

U.S. PATENT DOCUMENTS

| | | | | | |
|---|---|---|---|---|---|
| 1,316,398 | A | * | 9/1919 | Steininger | 81/177.7 |
| 2,978,938 | A | * | 4/1961 | Nalley | 81/177.7 |
| 3,188,895 | A | * | 6/1965 | Jones | 81/177.2 |
| 4,606,247 | A | * | 8/1986 | Graham | 81/177.6 |
| 5,305,668 | A | * | 4/1994 | Davis | 81/177.7 |
| 5,943,925 | A | * | 8/1999 | Huang | 81/177.7 |
| 6,138,533 | A | * | 10/2000 | Turtle | 81/124.3 |

* cited by examiner

*Primary Examiner*—Joseph J. Hail, III
*Assistant Examiner*—Joni B. Danganan
(74) *Attorney, Agent, or Firm*—Troxell Law Office PLLC

(57) ABSTRACT

Multisection wrench including a stem body and at least one jaw member or socket member connected with one end of the stem body for wrenching a screwed member. The stem body is composed of a predetermined number of identical connecting blocks which are longitudinally pivotally connected with each other. Each of opposite ends of two adjacent connecting blocks has at least one outward extending lug positioned side by side. A predetermined number of pivot pins are fitted in through holes of the side by side positioned lugs to pivotally connect the lugs, whereby the two adjacent connecting blocks are rotatable about the pivot pin to curve the stem body. The lateral sides of the side by side positioned lugs keep attaching to each other without departure. A predetermined number of resilient members are positioned between the contacting faces of the side by side positioned lugs to provide a resilient retaining force for the adjacent connecting blocks and achieve a locating effect. The stem body can be bent and located in a curved state.

15 Claims, 10 Drawing Sheets

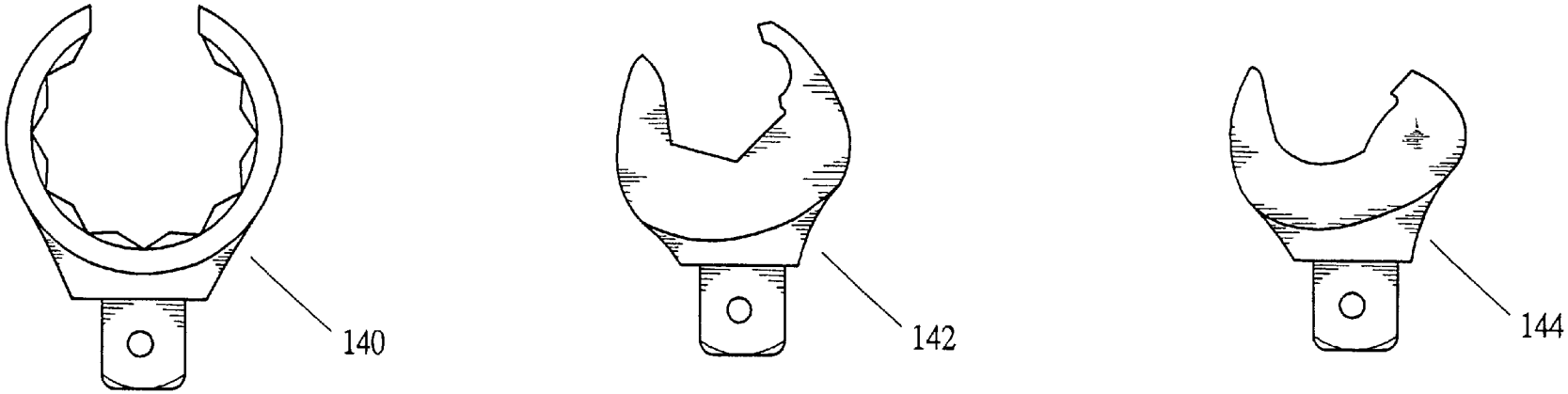
Fig.16
Fig.17
Fig.18
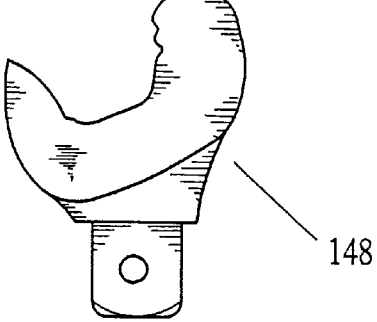
Fig.19
Fig.20

MULTISECTION WRENCH

BACKGROUND OF THE INVENTION

The present invention is related to a hand tool, and more particularly to a multisection wrench in which the stem body is composed of multiple connecting units which are pivotally connected with each other. The stem body can be bent and located in a desired curved state.

FIGS. 1 and 2 show a conventional multisection wrench 10. The stem body 12 of such wrench 10 includes several identical units 14 each of which is composed of multiple plate members 13. Each two adjacent units 14 are connected by a rivet 16, whereby the stem body 12 can be curved in accordance with the conditions of a working site.

The above wrench is disadvantageous in that the respective units are not located and are always loosened. Therefore, in use, the stem body often swings and it is hard to fit the jaws 17 or socket 18 onto a screwed member. Moreover, a user must hold the stem body with both hands so as to avoid undesired swinging thereof. This is quite inconvenient for the user.

Furthermore, it is quite time-consuming to assemble the stem body 12. Moreover, the head sections at two ends of the rivet 16 will protrude from the stem body so that the appearance of the wrench is poor and the user will feel uncomfortable when holding the stem body.

FIGS. 3 and 4 show another type of multisection wrench 20. Such wrench includes multiple units 22 which are pivotally connected to form a ring. Each unit 22 further has an outward extending jaw end 24. Each two adjacent units are riveted by a connecting block 26.

The above wrench 20 has several jaw ends 24 with different sizes for application to different dimensions of screwed members. However, the units 22 are also simply connected by rivets so that the stem body also tends to swing. In addition, the head sections at two ends of the rivet 25 and two sides 241 of the jaw end will protrude from the stem body so that the user will feel uncomfortable when holding the stem body. Moreover, such wrench is quite heavy and hard to operate as well as expensive.

SUMMARY OF THE INVENTION

It is therefore a primary object of the present invention to provide a multisection wrench in which the stem body is composed of multiple connecting units which can be located. Therefore, the stem body can be kept in a curved state without swinging.

It is a further object of the present invention to provide the above multisection wrench which can be comfortably held.

The present invention can be best understood through the following description and accompanying drawings wherein:

BRIEF DESCRIPTION OF THE DRAWINGS

FIGS. 16 to 20 show other jaw members or socket members which can be mounted on the wrench of the present invention.

DETAILED DESCRIPTION OF THE PREFERRED EMBODIMENTS

Figure 1:
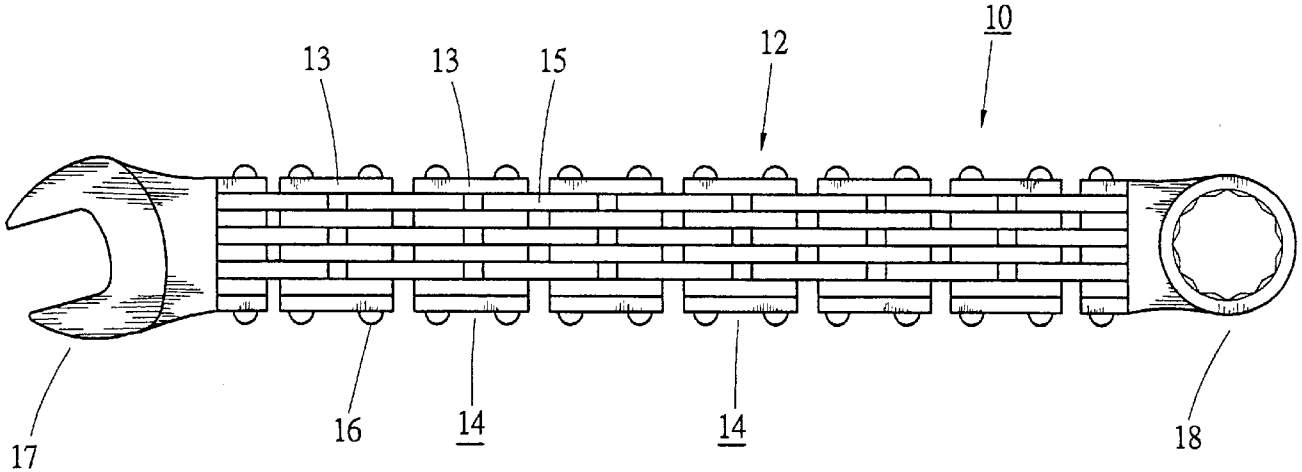
Fig.1 Prior Art
FIG. 1 is a front view of a conventional multisection wrench.
Figure 2:
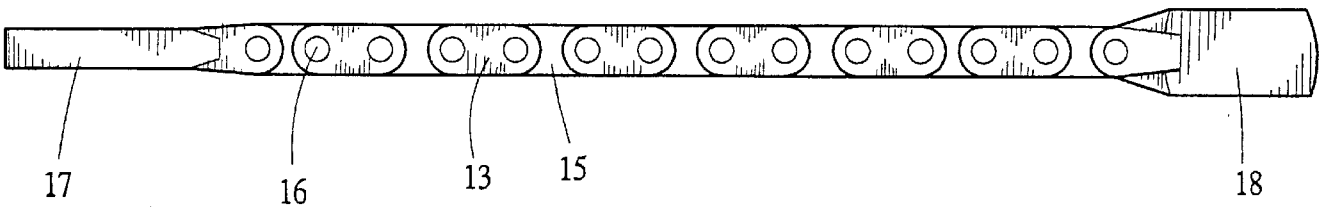
Fig.2 Prior Art
FIG. 2 is a top view according to FIG. 1.
Figure 3:
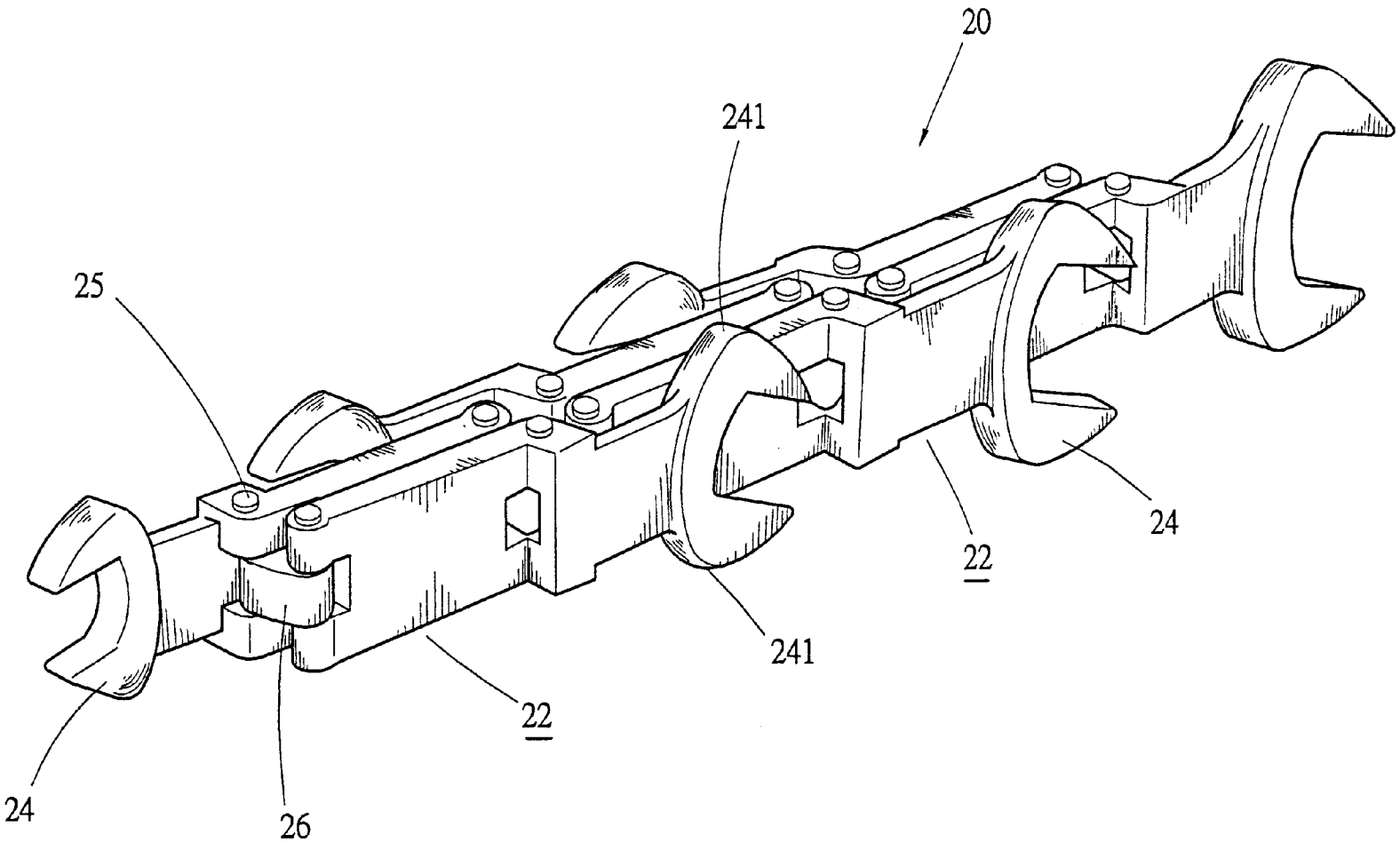
Fig.3 Prior Art
FIG. 3 is a perspective assembled view of another type of conventional multisection wrench.
Figure 4:
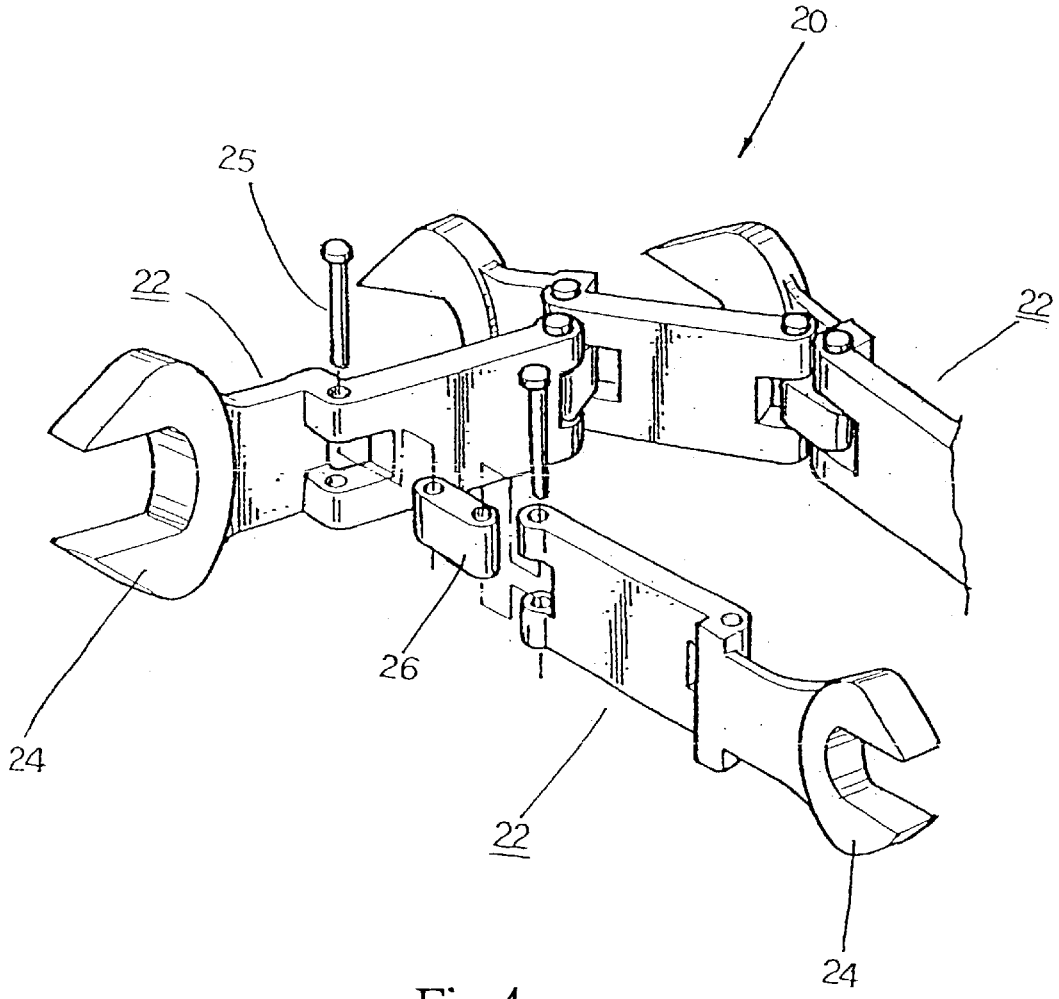
Fig.4 Prior Art
FIG. 4 is a perspective exploded view of a part of FIG. 3.
Figure 5:
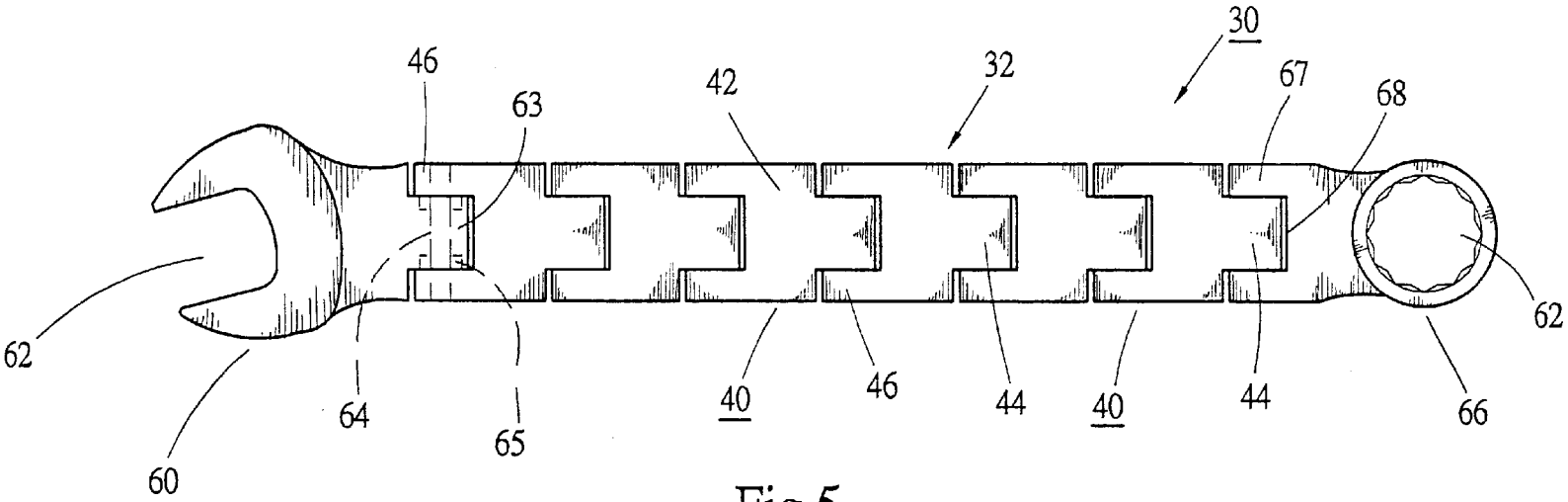
FIG. 5 is a front view of a preferred embodiment of the present invention.
Figure 6:
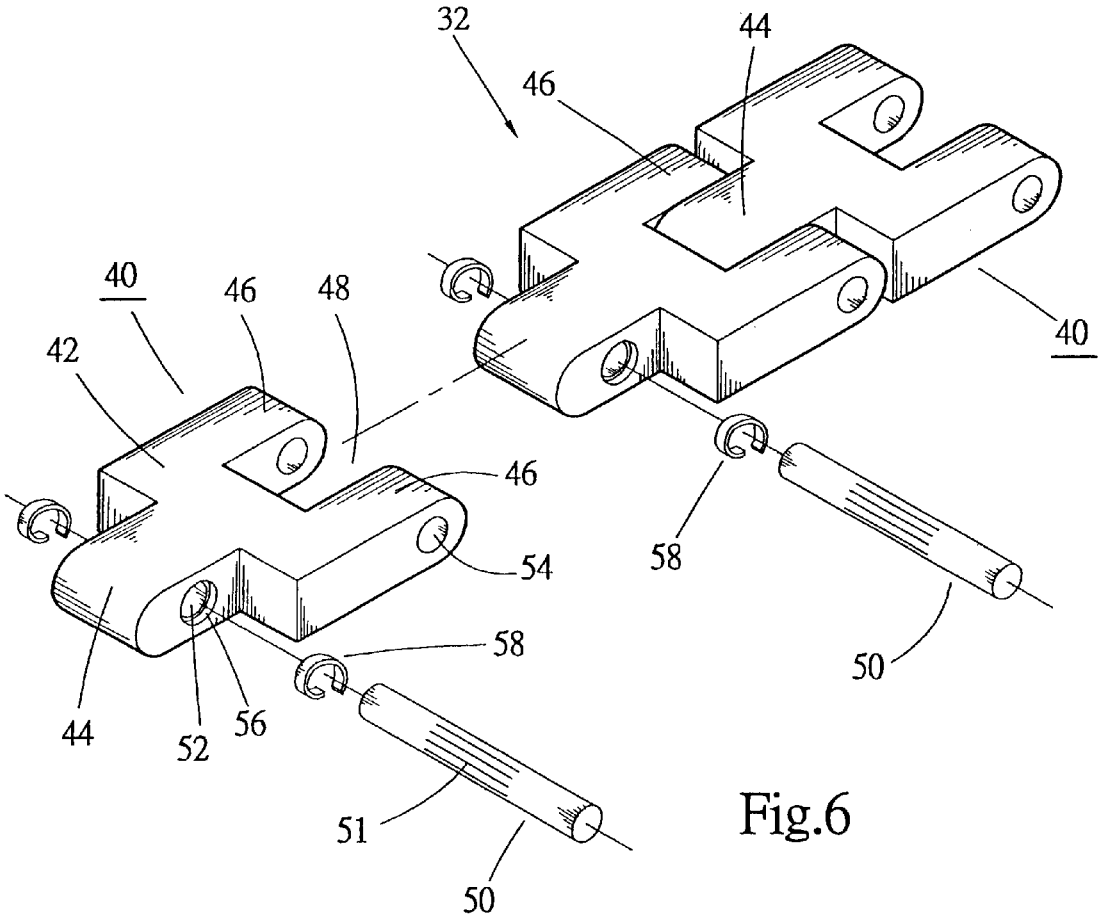
FIG. 6 is a perspective exploded view of a part of FIG. 5.
Figure 7:
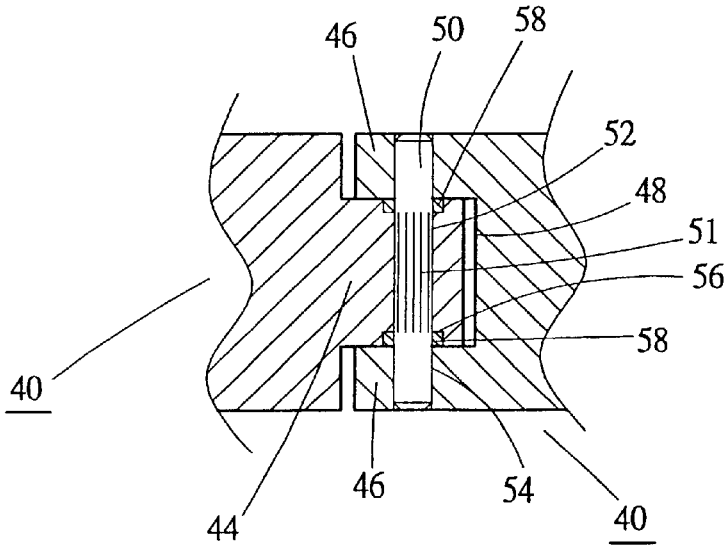
FIG. 7 is a sectional assembled view according to FIG. 6.

Please refer to FIGS. 5 to 7. According to a preferred embodiment, the multisection wrench 30 of the present invention includes a stem body 32 and a jaw member 60 and a socket member 66 connected with two ends of the stem body 32.

The stem body 32 is an elongated bar including six identical connecting blocks 40 which are longitudinally sequentially connected with each other. Each connecting block 40 has a rectangular main body 42. A first lug 44 outward extends from the middle of one end of the main body 42. Two second lugs 46 outward extend from two sides of the other end of the main body 42. The two second lugs 46 define therebetween a recess 48. The first lug 44 is formed with a first transverse through hole 52. Each second lug 46 is formed with a second transverse through hole 54. Two annular cavities 56 are formed on two side walls of the first lug 44 at two ends of the first through holes 52.

The opposite ends of each two adjacent connecting blocks 40 are connected in such a manner that the first lug 44 of a connecting block is fitted into the recess 48 of another connecting block, whereby the first and second lugs 44, 46 are positioned side by side.

A pivot pin such as an insertion pin 50 is forcedly fitted into the corresponding through holes 52, 54 to pivotally connect two adjacent connecting blocks 40. The middle portion of the insertion pin 50 is embossed with a spline section 51 which is tightly engaged with the inner wall face of the through hole 52 of the lug 44 as shown in FIG. 7, whereby the insertion pin 50 is prevented from being unplugged from the connecting block. The second lugs 46 are freely rotatable about two ends of the insertion pin. Accordingly, the two connecting blocks are rotatable about the pivot pin. The ends of the insertion pin do not protrude from the connecting block.

A C-shaped resilient washer 58 is placed in each annular cavity 56 between the contacting faces of the lugs 44, 46.

The jaw member 60 is formed with an opening 62 for wrenching a nut or a bolt. The other end of the jaw member 60 is formed with a lug 63 having a third through hole 64. Also, annular cavities 65 are formed on two sides of the lug 63. The jaw member 60 is connected with one end of the stem body 32. An insertion pin pivotally connects the lug 63 with the lugs 46 of a connecting block 40. Two resilient washers 58 are placed in the annular cavities 65 to provide a resilient retaining force between the lugs 63, 46. The socket member 66 is formed with a socket 62. The other end of the socket member 66 is formed with two lugs 67 and a recess 68. The socket member 66 is connected with a connecting block 40 at the other end of the stem body 32. An insertion pin pivotally connects the lugs 67, 44 with each other. Two resilient washers 58 are placed between the contacting faces of the lugs 67, 44 to provide a resilient retaining force.

Figure 8:
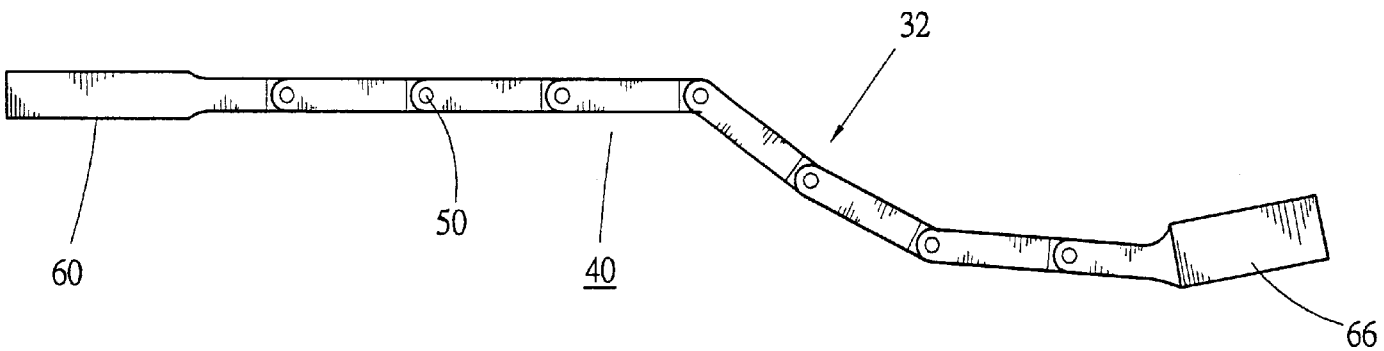
FIG. 8 is a top view according to FIG. 5, showing a bending state of the wrench of the present invention.

In use, as shown in FIG. 8, the stem body 32 is curved and the connecting blocks 40 are rotated about the insertion pins 50. By means of the retaining force provided by the resilient washers 58, the adjacent connecting blocks 40 can be adjustably located at a certain angle. Accordingly, the stem body 32 can be patterned in a curved state without loosening.

Figure 9:
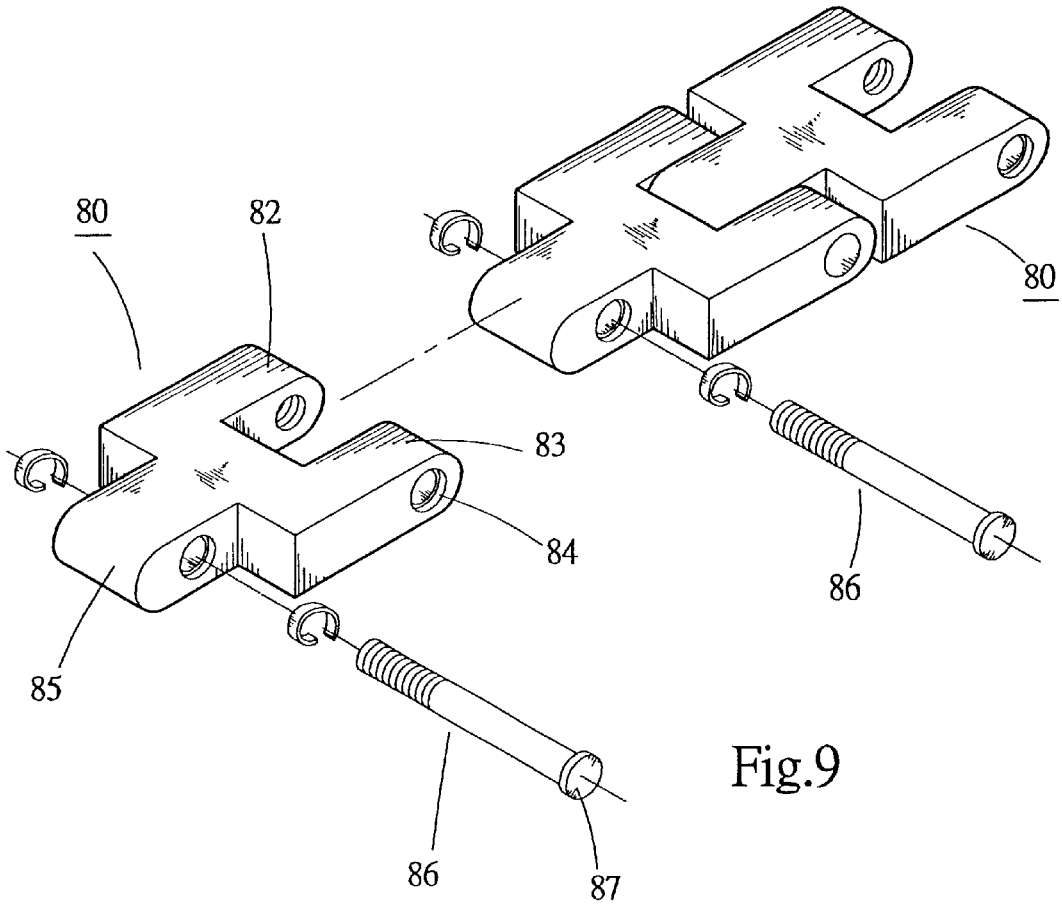
FIG. 9 is a perspective exploded view of a part of another embodiment of the present invention.
Figure 10:
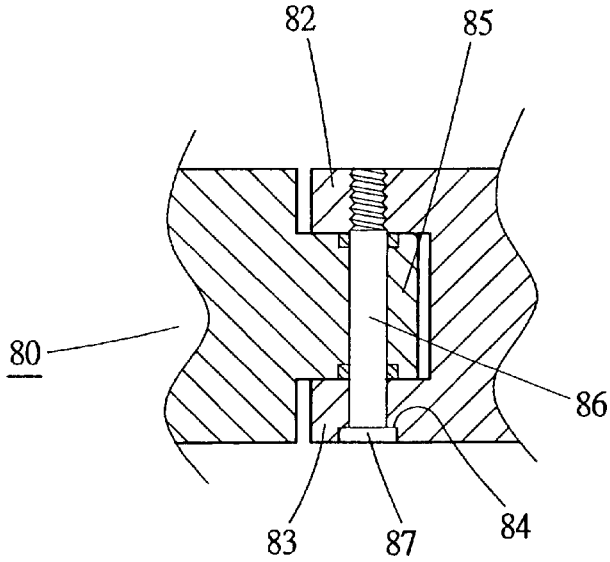
FIG. 10 is a sectional assembled view according to FIG. 9.

FIGS. 9 and 10 show another embodiment of the present invention. The difference between this embodiment and the above one is that the inner wall face of the through hole of one lug 82 of the second lugs of the connecting block 80 is formed with inner thread, while the outer side of the other lug 83 is formed with a cavity 84. The pivot pin is a bolt 86 passing through the lugs 82, 83, 85 of the adjacent connecting blocks. The bolt 86 is screwed in the lug 82 without dropping out. The head 87 of the bolt is accommodated in the cavity 84 of the lug 83. Two ends of the bolt do not protrude from the connecting block.

The lugs of the jaw member and socket member connected with two ends of the stem body are identical to the lugs 82, 83, 85 of the above embodiment and will not be further described herein.

Figure 11:
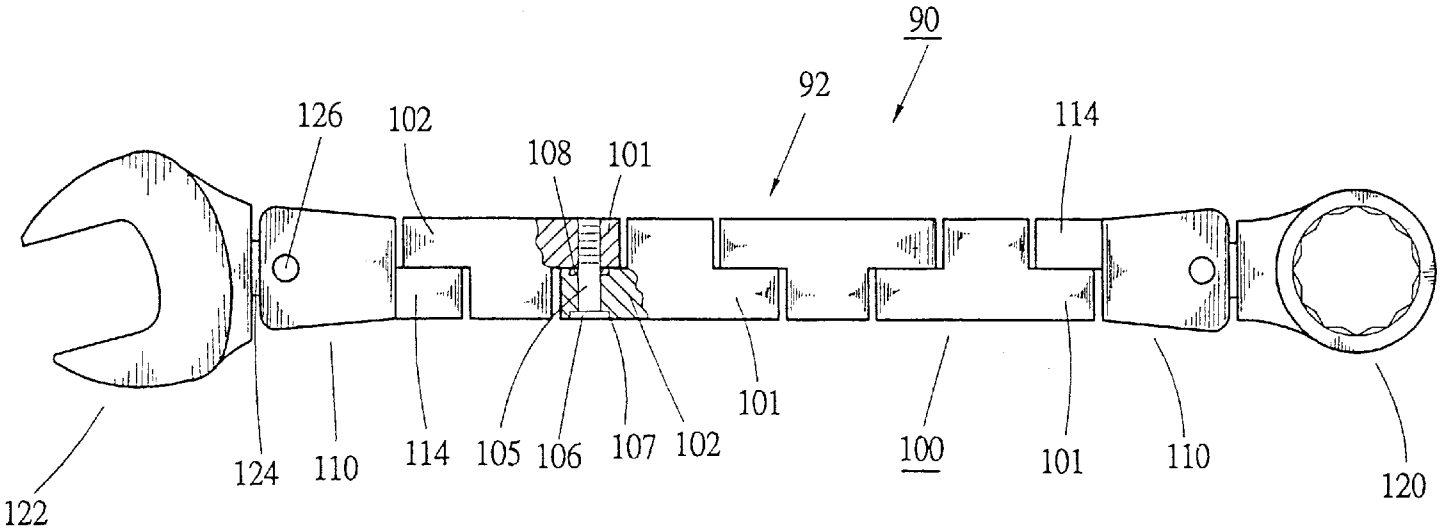
FIG. 11 is a front sectional view of a part of still another embodiment of the present invention.
Figure 12:
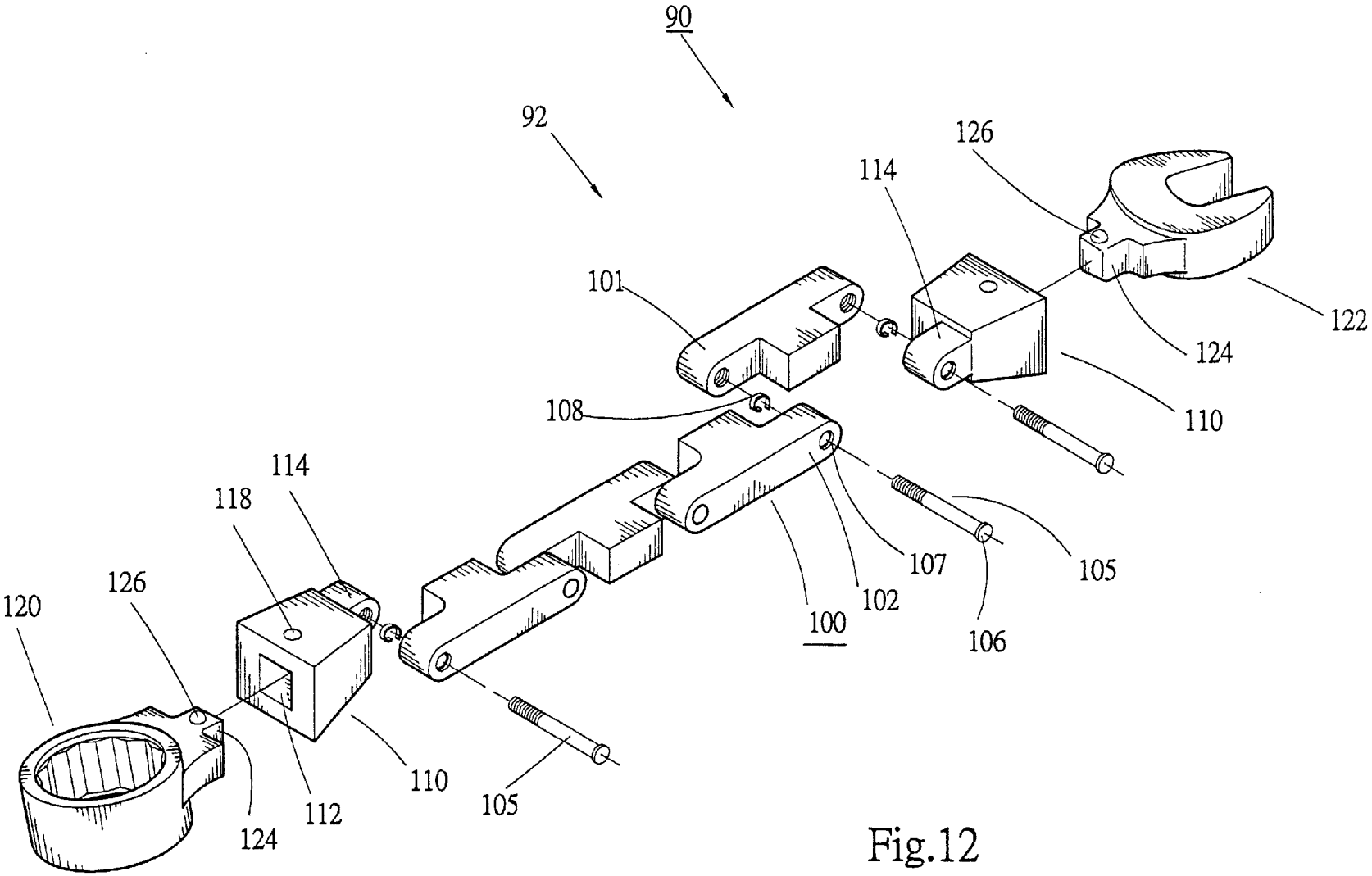
FIG. 12 is a perspective exploded view according to FIG. 11.

FIGS. 11 and 12 show still another embodiment of the wrench 90 of the present invention, in which the stem body 92 is composed of four connecting blocks 100 and two end blocks 110 which are longitudinally connected with each other.

The connecting block 100 is T-shaped. First and second lugs 101, 102 respectively outward extend from two ends of one side of the main body. The lugs 101, 102 of two adjacent connecting blocks are positioned side by side and connected by a screw 105. The end of the screw is screwed in the first lug 101, while the head 106 of the screw is accommodated in the cavity 107 of the second lug 102 [and leant] against the second lug 102. Accordingly, the two lugs 101, 102 are engaged with each other. A resilient washer 108 is received in the inner side of the lug 102 to provide a locating effect for the first and second lugs.

One end of each end block 110 is formed with a recess 112, while a lug 114 outward extends from one side of the other end of the end block 110. The two end blocks 110 are respectively connected with two ends of the stem body. The lug 114 of the end block is side by side pivotally connected with the lug 101 or 102 of a connecting block by a screw.

An insertion boss 124 outward protrudes from one end of each of the jaw member 122 and socket member 120. A bead body 126 pushed by a spring is inlaid in the insertion boss. The insertion boss 124 is inserted in the recess 112 of the end block 110. The bead body 126 is inserted in a through hole 118 formed on the end block to locate the jaw member or socket member.

Resilient washers 108 are placed between the adjacent connecting blocks and the pivotally connected connecting block and end block, whereby the stem body 92 can be located in a curved state. The jaw member and socket member can be taken off from the end blocks.

Figure 13:
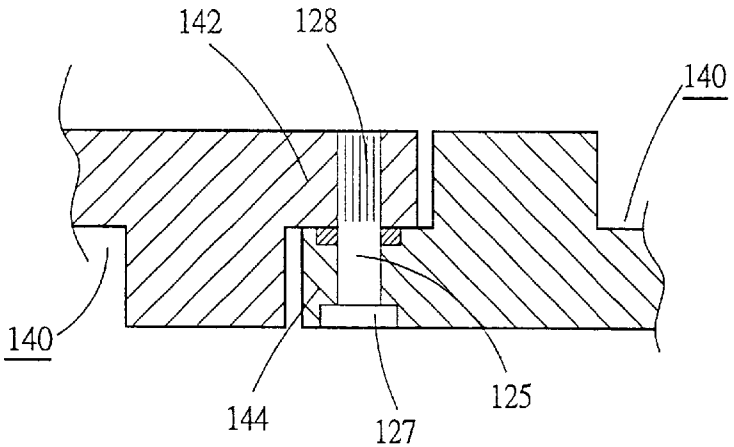
FIG. 13 is a sectional assembled view of a part of still another embodiment of the present invention.

FIG. 13 is a sectional view of still another embodiment of the present invention, in which the pivot pin is an insertion pin 125 with a head section 127. The end of the insertion pin is formed with a spline section 128 engaged with the first lug 142 of a connecting block 140, while the head section abuts against the second lug 144 of another connecting block. Therefore, the two lugs are connected against each other.

Figure 14:
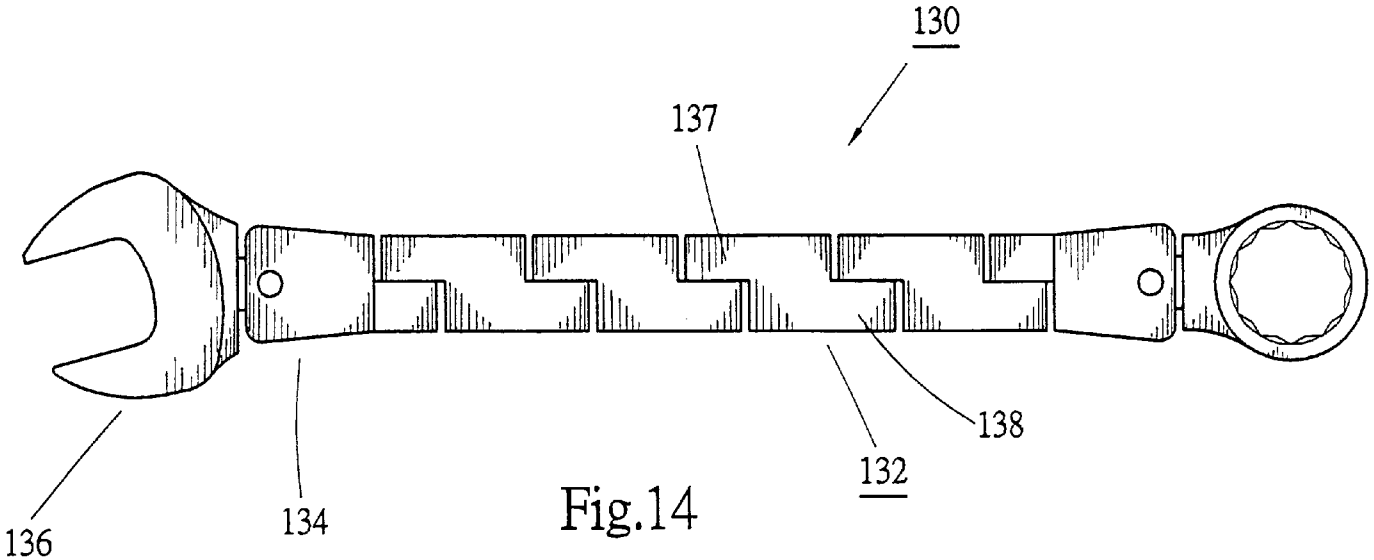
FIG. 14 is a front view of still another embodiment of the present invention.
Figure 15:
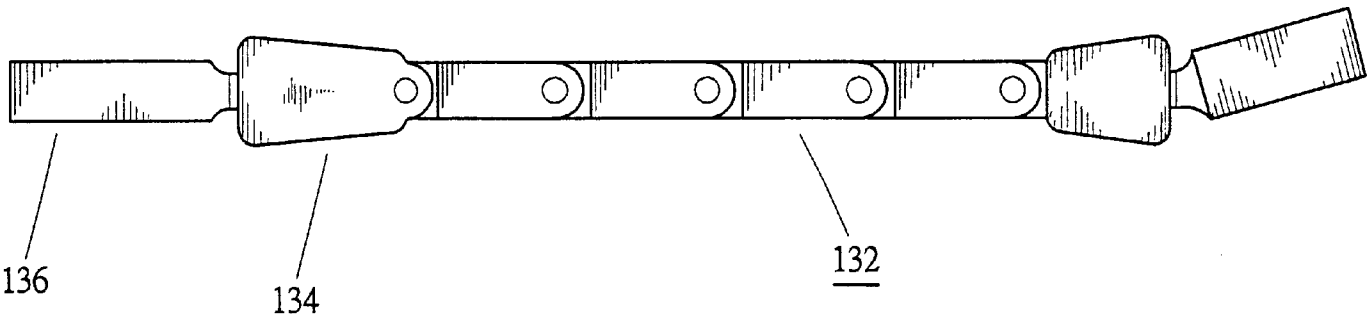
FIG. 15 is a bottom view according to FIG. 14.

FIGS. 14 and 15 show still another embodiment of the wrench 130 of the present invention, which includes several connecting blocks 132, end blocks 134 and jaw member 136 and socket member. The connecting block 132 is N-shaped. Two lugs 137, 138 project from different sides of two ends of the main body of the connecting block 132.

The present invention has the following advantages:

1. The respective connecting units of the wrench are retained by the resilient members and can be located at a desired curvature so that the stem body will not loosen or swing and can be operated by single hand. Accordingly, it is easy to aim the wrench at the screwed member and fit the wrench thereon.
2. With respect to the wrenches of FIGS. 11 and 15, the jaw member and socket member can be detached from the stem body and replaced by the jaw member and socket member 140, 142, 144, 146, 148 as shown in FIGS. 16 to 20. Accordingly, the wrench is applicable to various sizes of screwed members.
3. The connecting unit has simple structure and is easy to manufacture and assemble. Also, the weight and volume of the wrench can be greatly reduced so as to facilitate the operation.
4. The pivot pins are hidden in the stem body and there is no protrusion around the stem body so that a user can comfortably hold the wrench.

The above embodiments are only used to illustrate the present invention, not intended to limit the scope thereof. Many modifications of the above embodiments can be made without departing from the spirit of the present invention.

What is claimed is:

1. A multisection wrench comprising a stem body and at least one wrenching member connected with one end of the stem body, the stem body including a predetermined number of identical connecting blocks which are pivotally connected with each other, the wrenching member configured for wrenching a screwed member, wherein:

each opposite end of two adjacent connecting blocks has at least one outwardly extending lug formed with a transverse through hole, the lugs of two adjacent connecting blocks being positioned side-by-side;

a predetermined number of pivot pins fitted in the transverse through holes of the side-by-side positioned lugs to pivotally connect the lugs, whereby the two adjacent connecting blocks are rotatable about the pivot pins to curve the stem body, lateral sides of the side-by-side positioned lugs being kept adjacent to each other; and a predetermined number of resilient members positioned between contacting faces of the side-by-side positioned lugs to provide a resilient retaining force for the adjacent connecting blocks and achieve a locating effect, whereby the stem body can be bent and located in a curved state.

2. The multisection wrench as claimed in claim 1, wherein a first lug outwardly extends from a middle of a first end of the connecting block and two second lugs outwardly extending from a second end thereof, the two second lugs defining therebetween a recess, each two adjacent connecting blocks being connected such that the first lug of one of the connecting blocks is fitted into the recess of another of the connecting blocks, whereby the first and second lugs are positioned side-by-side.

3. The multisection wrench as claimed in claim 1, wherein one lug respectively outwardly extends from each of two ends of the connecting block, the two lugs being positioned on a same lateral side of the connecting block.

4. The multisection wrench as claimed in claim 1, wherein one lug respectively outwardly extends from each of two ends of the connecting block, the two lugs being respectively positioned on opposite lateral sides of the connecting block.

5. The multisection wrench as claimed in claim 1, wherein the contacting face of one of the side-by-side positioned lugs has a cavity at an end of the transverse through hole formed in the lug, the resilient member being a resilient washer placed in the cavity.

6. The multisection wrench as claimed in claim 1, wherein the wrenching member is pivotally connected with one of the connecting blocks at one end of the stem body, each of the wrenching member and the associated connecting block has at least one outwardly extending lug, the lugs being positioned side-by-side; a pivot pin being fitted in through holes of the side-by-side positioned lugs to pivotally connect the lugs; and at least one resilient member being positioned between contacting faces of the lugs.

7. The multisection wrench as claimed in claim 1, wherein the stem body further includes at least one end block which is pivotally connected with one of the connecting blocks, each of the end block and the associated connecting blocks having an outwardly extending lug, the lugs being positioned side-by-side; at least one pivot pin being fitted in the side-by-side positioned lugs to pivotally connect the end block and the connecting block and to keep the lugs adjacent to each other; at least one resilient member being positioned between contacting faces of the lugs, the end block being formed with a recess; and a predetermined number of wrenching members being provided, one end of each of the wrenching members having an insertion boss which is detachably inserted in the recess of the end block.

8. The multisection wrench as claimed in claim 1, wherein two opposite ends of each of the predetermined number of pivot pins do not protrude from the associated connecting block.

9. The multisection wrench as claimed in claim 1, wherein each of the predetermined number of pivot pins comprises a pin body, a circumference of the pin body being partially embossed with a spline section for engaging an inner wall face of the transverse through hole of one of the side-by-side positioned lugs, the other of the side-by-side positioned lugs being rotatable about the pin body.

10. The multisection wrench as claimed in claim 9, wherein one end of each of the predetermined number of pivot pins has an enlarged head section, the spline section of the pivot pin being engaged with one of the side-by-side lugs, while the head section bears against an outer side of the other of the side-by-side lugs.

11. The multisection wrench as claimed in claim 10, wherein the outer side wall of the lug against which the head section of the pivot pin bears against is formed with a cavity, the head section of the pivot pin being accommodated in the cavity.

12. The multisection wrench as claimed in claim 1, wherein the each of the predetermined number of pivot pins comprises a bolt, a rear end of the bolt being screwed in one of the side-by-side positioned lugs, a head of the bolt bearing against an outer side of the other of the side-by-side lugs.

13. The multisection wrench as claimed in claim 12, wherein the outer side of the lug against which the head section of the bolt bears against is formed with a cavity, the head section of the bolt being accommodated in the cavity.

14. The multisection wrench as claimed in claim 1, wherein the wrenching member comprises a jaw member.

15. The multisection wrench as claimed in claim 1, wherein the wrenching member comprises a socket member.

* * * * *